US007681601B2

(12) United States Patent
Kriz

(10) Patent No.: US 7,681,601 B2
(45) Date of Patent: Mar. 23, 2010

(54) INNER CASING OF A ROTATING THERMAL MACHINE

(75) Inventor: Davor Kriz, Baden (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 11/463,915

(22) Filed: Aug. 11, 2006

(65) Prior Publication Data

US 2007/0044860 A1 Mar. 1, 2007

(30) Foreign Application Priority Data

Aug. 24, 2005 (CH) ..... 1382/05

(51) Int. Cl.
*F16L 9/00* (2006.01)

(52) U.S. Cl. ..... 138/159; 138/157; 138/158; 138/162

(58) Field of Classification Search ..... 138/156–159, 138/162, 167, 137, 140, 141, DIG. 1; 285/419, 285/192; 415/173.1; 428/36.91
See application file for complete search history.

(56) References Cited

U.S. PATENT DOCUMENTS

| | | | | |
|---|---|---|---|---|
| 103,380 | A * | 5/1870 | Smith | 138/160 |
| 1,499,954 | A * | 7/1924 | Stiles | 138/157 |
| 3,014,741 | A | 12/1961 | McDowall | |
| 3,043,003 | A * | 7/1962 | Lever | 29/521 |
| 3,126,035 | A * | 3/1964 | Espetvedt | 138/162 |
| 3,628,572 | A * | 12/1971 | Shannon | 138/161 |
| 4,109,944 | A * | 8/1978 | Curtin | 285/373 |
| 4,431,373 | A | 2/1984 | Monsarrat | |
| 4,921,401 | A | 5/1990 | Hall et al. | |
| 4,967,800 | A * | 11/1990 | Heilmayr et al. | 138/162 |

(Continued)

FOREIGN PATENT DOCUMENTS

| | | |
|---|---|---|
| DE | 1056624 | 5/1959 |

(Continued)

OTHER PUBLICATIONS

Search Report for Swiss Patent App. No. Ch 1382/2005 (Dec. 27, 2005).

*Primary Examiner*—Patrick F Brinson
(74) *Attorney, Agent, or Firm*—Cermak Kenealy Vaidya & Nakajima LLP; Adam J. Cermak

(57) ABSTRACT

An inner casing (10) of a rotating thermal machine, in particular a steam turbine, has essentially the form of a hollow cylinder and is divided in a parting plane (20), which extends through an axis (11) of said casing, into a lower casing part (12) and an upper casing part (13), which casing parts (12, 13) are detachably connected to one another in the parting plane (20). The thermomechanical properties are improved with respect to casings provided with flanges in that the two casing parts (12, 13) have, in the region of the parting plane (20), two overlapping areas (14, 15) which lie opposite one another and in which the two casing parts (12, 13) overlap one another and are detachably connected to one another with overlapping sections (17, 18), in that the two casing parts (12, 13) have a predefined wall thickness (d), and in that the sum of the thicknesses of the overlapping sections (17, 18) is approximately the same as the wall thickness (d) of the two casing parts (12, 13) in the overlapping areas (14, 15).

8 Claims, 1 Drawing Sheet

U.S. PATENT DOCUMENTS

| | | | | |
|---|---|---|---|---|
| 5,007,666 | A * | 4/1991 | Kyfes | 285/373 |
| 5,875,821 | A * | 3/1999 | Dumser et al. | 138/162 |
| 6,247,500 | B1 * | 6/2001 | McMahon | 138/157 |
| 6,273,675 | B1 | 8/2001 | Magoshi et al. | |
| 6,336,789 | B1 | 1/2002 | Beerens et al. | |
| 6,431,216 | B1 * | 8/2002 | Briscoe | 138/110 |
| 6,550,819 | B2 * | 4/2003 | DeSanto, Sr. | 285/192 |
| 2006/0285971 | A1 * | 12/2006 | Matheny | 415/173.1 |

FOREIGN PATENT DOCUMENTS

| | | |
|---|---|---|
| JP | 52119704 | 10/1977 |
| SU | 364750 | 12/1972 |

* cited by examiner 20
13
14
15
12
10
II
II
11

16
19
d
13
19
15
16
17
18
12

INNER CASING OF A ROTATING THERMAL MACHINE

This application claims priority under 35 U.S.C. § 119 to Swiss application number 01382/05, filed 24 Aug. 2005, the entirety of which is incorporated by reference herein.

BACKGROUND OF THE INVENTION

1. Field of the Invention

The present invention relates to the field of thermal machines. It relates to an inner casing of a rotating thermal machine.

2. Brief Description of the Related Art

Inner casings of a steam turbine are usually composed of two half shells, specifically an upper and a lower casing half which are screwed to one another in the horizontal parting plane by means of flanges which are arranged on the shells (see for example document U.S. Pat. No. 6,273,675 B1).

It is known that various problems may occur owing to the high temperatures occurring at the casing and the flanges which are screwed to one another: the casing is mechanically very rigid in the region of the flanges while it is comparatively weak at the poles which do not have flanges. As a result, it is possible for oval deformations (in cross section) to occur, i.e., radial deformations which result in grinding of the tips of the blades which rotate in the interior against the casing walls or a large amount of play between the blade tip and the casing wall, which adversely affects the efficiency.

In the past, proposals have already been made to reduce the radial deformations by means of a specific configuration of the casing while retaining the flanges (U.S. Pat. No. 6,336,789 B1). These solutions require additional space and additional material but basically do not change the asymmetry caused by the flanges.

SUMMARY OF THE INVENTION

One aspect of the present invention includes providing an inner casing of a rotating thermal machine which avoids the disadvantages of known inner casings and is distinguished in particular by reduced consumption of material, reduced requirement for space and a high degree of symmetry while having a simple design.

Another aspect of the present invention is distinguished by the fact that the two casing parts have, in the region of the parting plane, two overlapping areas which lie one opposite the other and in which the two casing parts overlap one another and are detachably connected to one another with overlapping sections, in that the two casing parts have a predefined wall thickness, and in that the sum of the thicknesses of the overlapping sections is approximately the same as the wall thickness of the two casing parts in the overlapping areas.

One configuration of the invention is distinguished by the fact that the overlapping areas extend in the circumferential direction, in each case through an angle between 10° and 25°, preferably approximately 18°.

Another configuration of the invention is characterized by the fact that the overlapping sections of the two casing parts have approximately the same wall thickness.

A further configuration of the invention is distinguished by the fact that the two casing parts within the overlapping sections are each detachably connected to one another by a screwed connection, the screwed connections include a multiplicity of bolts which are arranged distributed in the overlapping areas, and that the bolts are arranged distributed according to a regular pattern within the overlapping areas.

BRIEF DESCRIPTION OF THE DRAWINGS

The invention will be explained in more detail below by means of exemplary embodiments and with reference to the drawing, in which.

DETAILED DESCRIPTION OF EXEMPLARY EMBODIMENTS

Figures 1, 2, 3, 4:
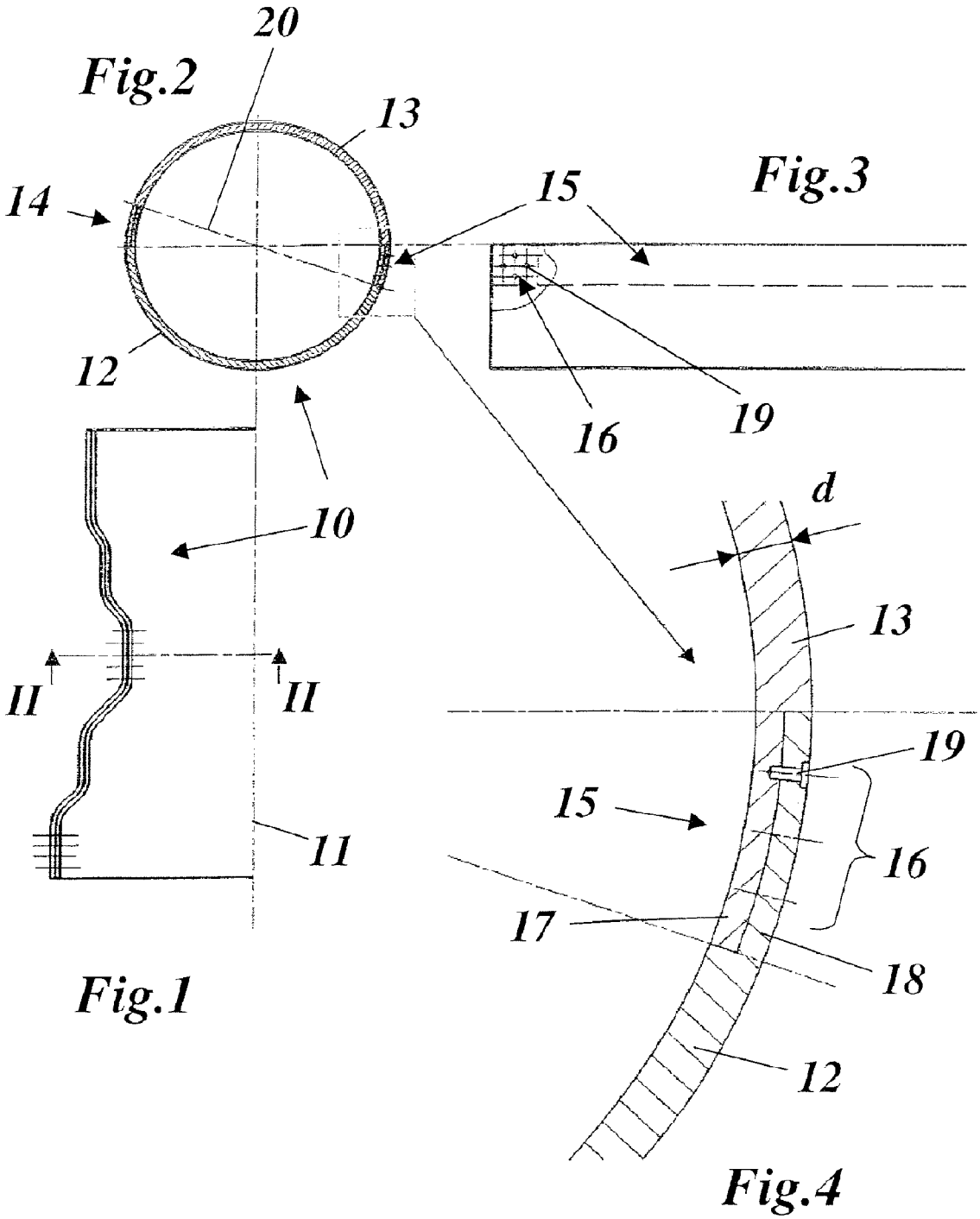
FIG. 1 shows the axial section through an inner casing of a medium pressure steam turbine with an alternating casing contour for different blade ducts and tapping points, in which section, for example, an implementation of the invention is shown.
FIG. 2 shows the cross section through the casing illustrated in FIG. 1, along the plane II-II in FIG. 1.
FIG. 3 shows the embodiment of the screwed connection in the exemplary embodiment in FIG. 2.
FIG. 4 shows an enlarged detail of one of the overlapping areas of the lower and upper casing parts in FIG. 2.

In FIG. 2, the cross section is represented by an inner casing 10 of a steam turbine according to an exemplary embodiment of the invention. The inner casing 10, which extends along an axis 11 and can have, for example, the diameter contour shown in FIG. 1 (for the medium pressure part of a two-channel steam turbine), is composed of an upper casing part 13 and a lower casing part 12. The two casing parts 12, 13 are assembled without the customary, laterally protruding flanges to form a virtually perfect, circular hollow cylinder, and are screwed to one another using a multiplicity of bolts 19 which are arranged in distributed fashion. The bolts 19 are orientated in the radial direction here.

For this purpose, the two casing parts 12 and 13 have, in the region of the parting plane 20, two overlapping areas 14, 15 which lie one opposite the other and in which the two casing parts 12, 13 overlap one another and are detachably connected to one another with overlapping sections 17, 18 (FIG. 4). The two casing parts 12, 13 have a predefined wall thickness d outside the overlapping areas 14, 15. The sum of the thicknesses of the overlapping sections 17, 18 is approximately the same as the wall thickness d of the two casing parts 12, 13 in the overlapping areas 14, 15 so that a continuously constant wall thickness, and thus largely homogeneous thermomechanical properties, are obtained over the entire circumference of the inner casing 10. Particularly favorable properties are obtained if the overlapping sections 17, 18 of the two casing parts 12, 13 have approximately the same wall thickness here.

The extent of the overlapping areas 14, 15 is selected such that sufficient mechanical stability is provided given the forces prevailing at and in the inner casing 10. It has proven effective if the overlapping areas 14, 15 extend in the circumferential direction, in each case through an angle between 10° and 25°, preferably approximately 18°.

As has already been mentioned above, the two casing parts 12, 13 within the overlapping sections 17, 18 are each detachably connected to one another by a screwed connection 16. The screwed connections 16 comprise a multiplicity of bolts 19 which are arranged distributed in the overlapping areas 14, 15 and which, according to the figure, are arranged distributed according to a regular pattern within the overlapping areas 14, 15.

Since there are no flanges in the parting plane with the solution according to the invention, a uniform distribution of the forces is obtained over the entire circumference, which reduces deformations of the casing which deviate from the circle to a minimum.

Owing to the overlapping screwed connection, the casing can be cast in virtually any desired, even complicated form, as is illustrated by way of example in FIG. 1. In the parting plane 20 there is a perfect mirror image, which permits the two casing halves to be fitted well to one another and allows easy mounting.

LIST OF REFERENCE SYMBOLS

10 Inner casing (steam turbine)
11 Axis
12 Lower casing part
13 Upper casing part
14, 15 Overlapping area
16 Screwed connection
17, 18 Overlapping section
19 Bolt
20 Parting plane
d Thickness (casing wall)

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A rotating thermal machine comprising:

an inner casing comprising a hollow cylinder defining an axis;

said hollow cylinder having a diameter contour with a diameter varying along said axis and forming different blade ducts;

said hollow cylinder being divided at a parting plane, the parting plane extending though the cylinder axis, the cylinder including a lower casing part and an upper casing part, the casing parts detachably connected to one another in the parting plane;

wherein the two casing parts have, in the region of the parting plane, two overlapping areas which lie opposite each other and in which region the two casing parts overlap one another and are detachably connected to one another with overlapping sections;

wherein the two casing parts have a predefined wall thickness; and wherein the sum of the thicknesses of the overlapping sections is approximately the same as the wall thickness of the two casing parts in the overlapping areas.

2. The rotating thermal machine as claimed in claim 1, wherein the overlapping areas extend in the circumferential direction though an angle between 10° and 25°.

3. The rotating thermal machine as claimed in claim 1, wherein the overlapping sections of the two casing parts have approximately the same wall thickness.

4. The rotating thermal machine as claimed in claim 1, further comprising:

a screw connection detachably connecting the two casing parts within the overlapping sections.

5. The rotating thermal machine as claimed in claim 4, wherein the screw connection comprises a multiplicity of bolts distributed in the overlapping areas.

6. The rotating thermal machine as claimed in claim 5, wherein the bolts are distributed according to a regular pattern within the overlapping areas.

7. The rotating thermal machine as claimed in claim 1, wherein the rotating thermal machine comprises a steam turbine.

8. The rotating thermal machine as claimed in claim 1, wherein the overlapping areas extend in the circumferential direction through an angle of approximately 18°.

* * * * *